US011547217B1

(12) United States Patent
Ayres

(10) Patent No.: US 11,547,217 B1
(45) Date of Patent: Jan. 10, 2023

(54) MATTRESS ASSEMBLY WITH SEGMENTED BORDER WIRES

(71) Applicant: Don Ayres, Northbrook, IL (US)

(72) Inventor: Don Ayres, Northbrook, IL (US)

( * ) Notice: Subject to any disclaimer, the term of this patent is extended or adjusted under 35 U.S.C. 154(b) by 745 days.

(21) Appl. No.: 16/570,828

(22) Filed: Sep. 13, 2019

Related U.S. Application Data

(62) Division of application No. 15/420,672, filed on Jan. 31, 2017, now abandoned.

(51) Int. Cl.

| | |
|---|---|
| ***A47C 27/06*** | (2006.01) |
| ***A47C 27/16*** | (2006.01) |
| ***A47C 27/14*** | (2006.01) |
| ***A47C 27/00*** | (2006.01) |

(52) U.S. Cl.
CPC ..... *A47C 27/066* (2013.01); *A47C 27/001* (2013.01); *A47C 27/064* (2013.01); *A47C 27/14* (2013.01); *A47C 27/16* (2013.01)

(58) Field of Classification Search
CPC ..... A47C 27/14; A47C 27/16; A47C 23/007; A47C 23/26; A47C 23/005; A47C 27/06; A47C 27/066; A47C 31/023; A47C 31/04; A47C 7/342; A47C 27/15; A47C 27/20; A47C 27/127; A47C 31/06; A47C 27/05; A61G 13/02; B68G 7/105
See application file for complete search history.

(56) References Cited

U.S. PATENT DOCUMENTS

| | | | | |
|---|---|---|---|---|
| 1,528,066 | A | 3/1925 | McIntire | |
| 1,889,263 | A | 11/1932 | Reed | |
| 1,933,816 | A * | 11/1933 | Meutsch | A47C 27/066 5/652 |
| 2,065,423 | A | 12/1936 | Bronstein | |
| 5,289,600 | A | 3/1994 | Schermel | |
| 5,370,373 | A | 12/1994 | Bruner et al. | |
| 5,636,396 | A | 6/1997 | Workman et al. | |
| 5,924,150 | A | 7/1999 | Workman | |

(Continued)

FOREIGN PATENT DOCUMENTS

| | | | | |
|---|---|---|---|---|
| KR | 101000507 | B1 * | 7/2010 | A47C 23/043 |

OTHER PUBLICATIONS

KR101000507 English Translation (Year: 2010).*

*Primary Examiner* — Eric J Kurilla
*Assistant Examiner* — Amanda L Bailey
(74) *Attorney, Agent, or Firm* — John C. Shepard

(57) ABSTRACT

Disclosed is a mattress assembly having a spring or foam core structure and reduced-sized parts. Spaced along the mattress top and bottom border are a plurality of bands having through-openings. Border wire segments extend through the through-openings and are joined end-to-end by releasable connectors to form a continuous border wire providing edge support. Butterfly springs having tube-like bands for receiving the border wire segments prevent sagging. In spring mattresses, the bands, which may be rings or a similar type part, are carried at the top and bottom of the outer springs. In foam mattresses, the bands are formed by a plurality of loops formed in a continuous folded strip fixed by adhesive or other means to the mattress border walls. Two such mattresses may be joined together by interweaving a flexible cord through the bands of adjoining mattresses. The mattress assembly is completed by encasing in an outer cover.

13 Claims, 10 Drawing Sheets

(56) References Cited

U.S. PATENT DOCUMENTS

| | | | | |
|---|---|---|---|---|
| 5,970,547 | A | 10/1999 | Cavazos | |
| 6,233,760 | B1 | 5/2001 | Cavazos | |
| 6,842,927 | B2 | 1/2005 | England | |
| 7,017,997 | B2 * | 3/2006 | Takezawa | B60N 2/5825 297/452.6 |
| 7,287,291 | B2 * | 10/2007 | Carlitz | A47C 27/06 5/717 |
| 7,917,980 | B2 | 4/2011 | Kluft | |
| 8,935,819 | B1 | 1/2015 | Hartley | |
| 2004/0074005 | A1 * | 4/2004 | Kuchel | A47C 27/066 5/717 |
| 2009/0013476 | A1 * | 1/2009 | Rinchetti | A47C 23/04 5/717 |
| 2009/0038080 | A1 | 2/2009 | Grigg | |
| 2015/0296995 | A1 | 10/2015 | Krim et al. | |

* cited by examiner

MATTRESS ASSEMBLY WITH SEGMENTED BORDER WIRES

CROSS-REFERENCE TO RELATED APPLICATION

This application is a division of and claims the benefit and priority from U.S. Nonprovisional application Ser. No. 15/420,672, filed Jan. 31, 2017, the disclosure of which is herein incorporated by reference in its entirety.

BACKGROUND OF THE INVENTION

Technical Field

The present invention relates to mattresses and, more particularly, to a mattress assembly having a foam body and segmented border wires.

Background Art

Typically, a conventional coiled spring mattress has a supporting core including a rectangular array of coiled springs in side-by-side relation that are usually joined together by a clip or ferrule. Sometimes each coiled spring is encased in a fabric wrapping or pocket that may be sewn or glued to an adjoining spring wrapping. To provide some rigidity or stability along the top and bottom edge rims of the mattress, heavy gauge border wires are attached to the lateral edges of the outermost springs. Optionally extending between the border wires are a plurality of butterfly-shaped edge springs providing additional edge support and preventing sagging. This spring structure is encased in an outer upholstery-type fabric cover.

Usually disposed between the springs and top quilted ticking of the cover is a comfort layer that may include fiber padding, insulation, polyurethane foam, and other similar materials. These materials provide comfort for a person lying on the mattress by separating him from the springs, wires and connecting parts making up the supporting core. The mattress is often placed on a foundation, box spring or other support that raises it off the floor.

Also presently available are foam mattresses and air mattresses that do not employ springs. The supporting core can include an upper padded layer, a gel foam layer, a memory foam layer, and a high-density foam base. While foam mattresses and air mattresses are also encased in an outer cover, they do not employ border wires or edge support springs.

Mattresses come in a variety of standard sizes beginning with a twin bed having a size of 34 inches wide by 74 inches long up to a king size bed having a size 76 inches wide by 80 inches long. Mattresses may vary in thickness from about 6 inches to 18 inches or more. Depending on construction and the material used, smaller sizes may weigh less than 50 pounds, but larger sizes may weigh 100 pounds or more.

Mattresses, whether they be single, double, queen, or king size, are large and heavy and they are also flexible and floppy. They are manufactured and shipped as a single unit. Typically, they cannot be disassembled, folded, or otherwise compacted so they can be easily shipped or transported. A person often requires the help of an additional person to move a mattress and they will still have difficulty moving the mattress when navigating small doorways, narrow hallways, stairways, elevators, and the like. Since they will not fit into cars, they are often tied down onto the car's roof or require that a truck or trailer be employed.

A recent trend is selling foam mattresses rolled up in a shipping carton. Although this addresses some of the portability and handling challenges, these products lack a firm edge and the ability to customize the "his and hers" sleep surface.

In addition, mattresses are made to have a uniform firmness over their entire area. If two people are sleeping in a bed, they have to agree upon the type of mattress (coiled spring or foam) and the firmness of the mattress at the time of purchase.

BRIEF SUMMARY OF THE INVENTION

The present invention is directed to overcoming one or more of the problems as set forth above.

It is one object of the present invention to provide a mattress assembly that can be easily moved.

It is another object of the present invention to provide a mattress assembly that can be customized.

A feature of the mattress assembly disclosed herein is that relatively short wire segments are joined together end-to-end by releasable connectors to form a single continuous border wire at the top and bottom borders of the mattress.

Another feature of the mattress assembly disclosed herein is that bands with through-holes are attached to the edges of the supporting core structure so that the border wire segments can be passed through the bands and thereby be attached to the mattress border.

In one use of the mattress assembly shown herein, two mattress assemblies can be joined together to form a larger mattress.

A further feature of the mattress assembly is that the segmented border wire can be used with foam cores or in combination with spring cores.

An additional feature is that edge support springs having mounting sleeves can be positioned between the top and bottom border wires segments during assembly.

In one aspect of the invention, only four border wires are employed around the mattress core each having a long straight length, a short straight length and joined by an intermediate 90° corner, with the short length having a length only long enough to extend into and fixed to the connector.

In another aspect of the invention, an elongate union is provided to join two mattresses together, the mattresses having opposed laterally extending slides and the union having opposed slots sized and shaped to mate with the slides and hold the mattresses in side-by-side relation.

In another aspect of the invention, a kit is provided that contains border wire segments, connectors, optional edge springs, and a mattress core or cores packaged in a compact shipping container that enables a user to join two mattresses together, for example, two foam mattresses or a foam mattress and a spring mattress.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

Figure 1:
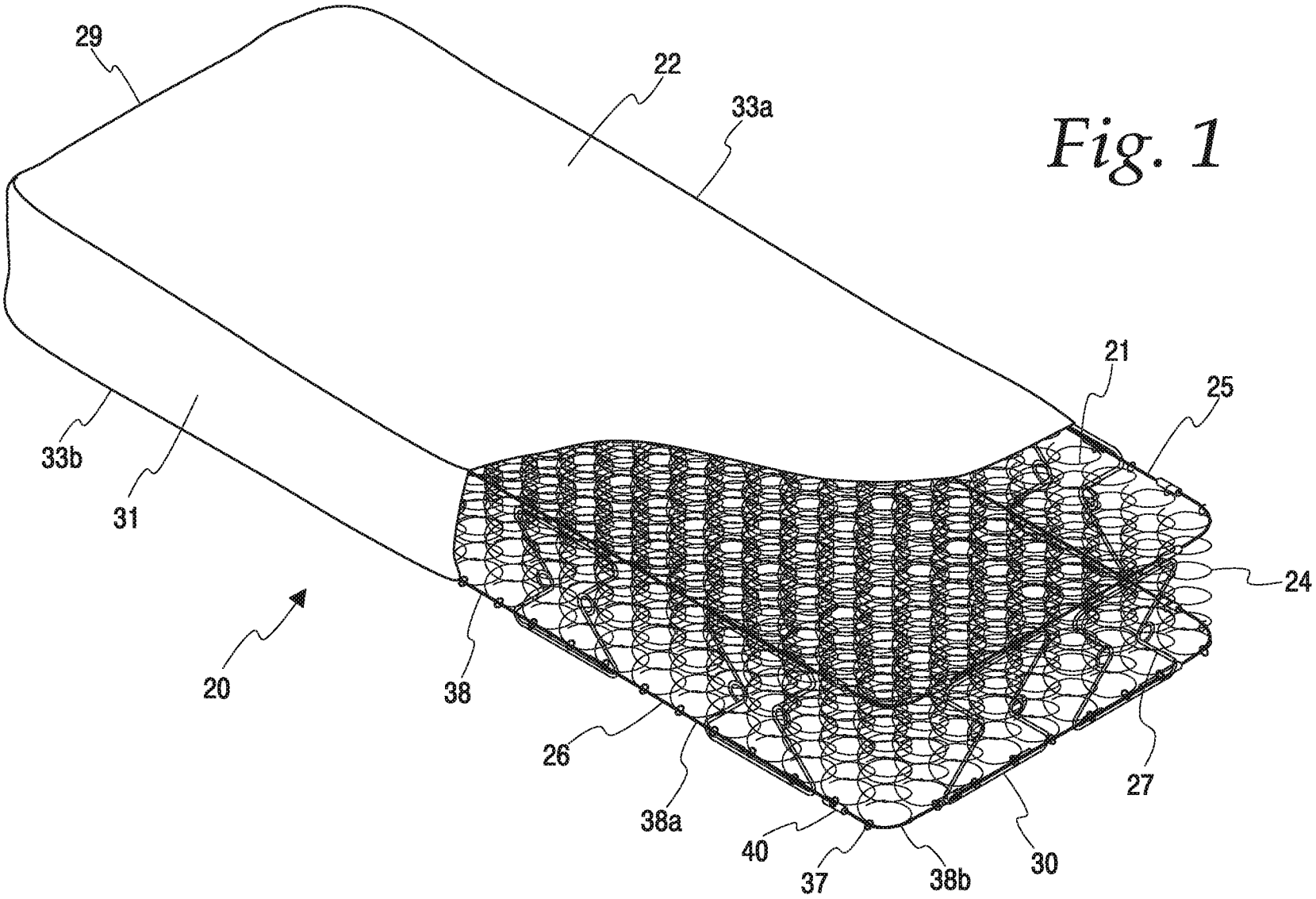
FIG. 1 is a perspective view of a mattress formed with coiled springs with the cover broken away to show the inner spring core.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As seen in FIG. 1, a mattress assembly, generally designated 20, is seen to include an inner supporting core structure 21 and a removable outer cover 22. The supporting structure 21 is formed from an array of coiled springs, collectively designated 24 top and bottom border wires 25 and 26, respectively, and edge support springs, collectively designated 27.

The coiled springs 24 are arranged in a rectangular matrix with the upper spring turns forming the top of the core and the lower spring turns forming the bottom of the core. The outer rows of springs 24 define a length between the head end 29 and the foot end 30 and a width between the lateral peripheral sides 31. The depth of the mattress core is defined by the height of the coiled springs 24. The rims or edges of the mattress are defined by the top and bottom borders 33*a* and 33*b* where the top and bottom sides intersect the ends and sides.

Figure 2:
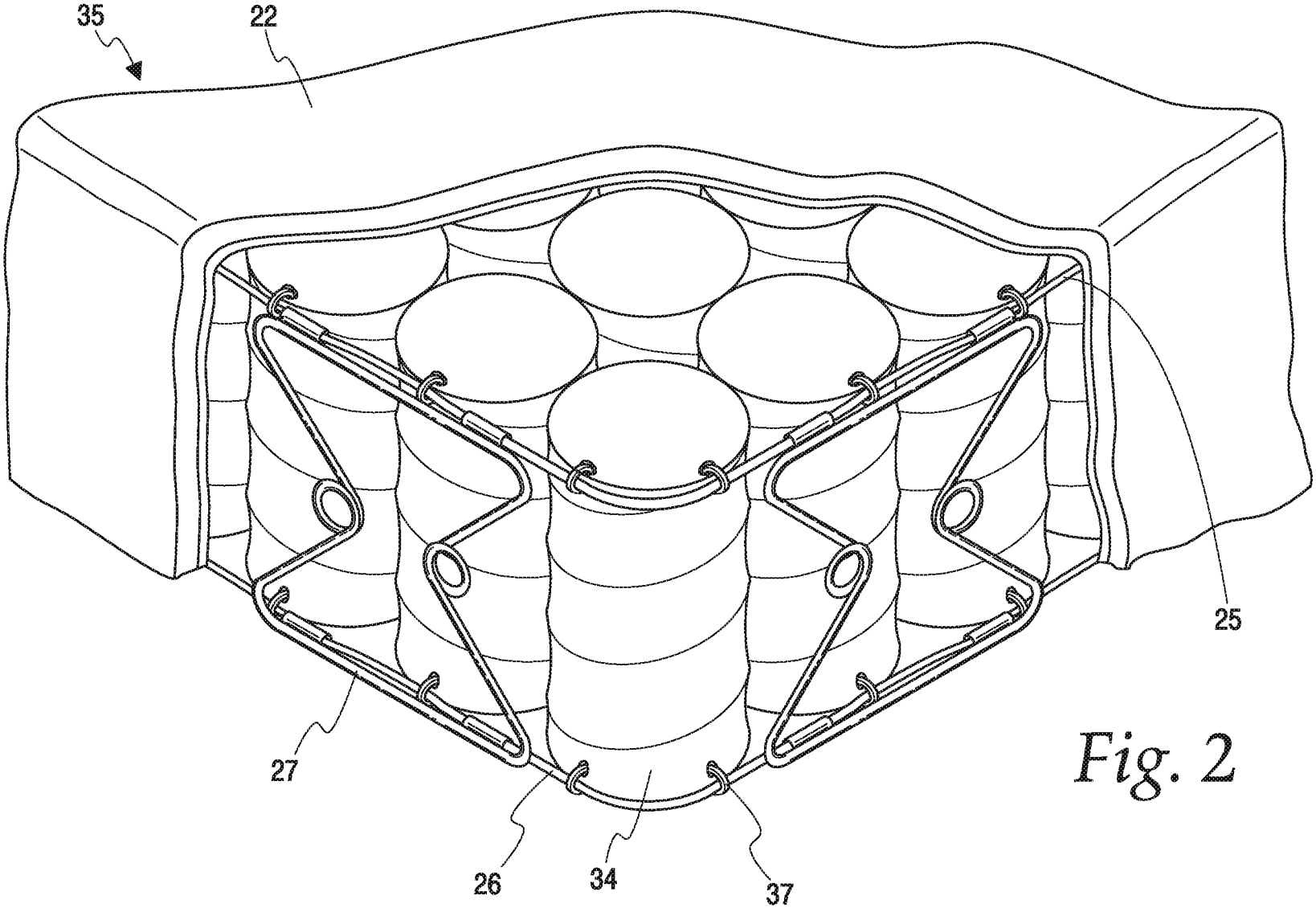
FIG. 2 is an enlarged fragmentary perspective view of one corner of a mattress core in which the coiled springs are encased in fabric sleeves.

Adjoining springs 24 may be independent of one another, or fixed together, or encased in fabric sleeves 34 as shown in FIG. 2 with respect to mattress assembly 35. As seen in FIGS. 1 and 2, bands, collectively designated 37, are carried by the upper and lower turns of the coiled springs 24 in the outermost rows and extend outwardly from the border. As used herein, the term "band" shall include ring (closed rings, split rings, hog rings, D-rings, and the like), loop, circle cotter, hoop, doughnut, coil, sleeve, tube, barrel and any other structure at least partially encircling or wrapping two or more parts or portions thereof to join them together.

In FIG. 2, the bands 37 penetrate the sleeves 35 and attach to the springs inside. When in use, the through-openings in respective rings are aligned serially in spaced relation along the border at the head end, foot end, and lateral sides at the top and bottom of the supporting structure 21 so that the border wires 25 and 26 may be received therein.

Each of the generally rectangularly-shaped border wires 25 and 26 is constructed from a plurality of separable short segments, collectively designated 38, made of heavy gauge wire. Each border wire segment 38 is preferably between 3 and 6 feet in length, but may be shorter or longer. Intermediate each pair of adjoining segments 38 is a releasable coupling connector, collectively designated 40, aligning and fixedly holding the connecting ends of the border segments in end-to-end relation. When all of the segments 38, which are made up of straight segments 38*a* and corner segments 38*b* bent at a 90° angle, are joined together, they form a single continuous border wire surrounding the upper and lower edges of the mattress. The corner segments have a curved or arcuate center portion subtending a 90° arc and straight end portions extending tangentially from each end of the center segment. Preferably, the straight end portions have a length only sufficient to be inserted into the end of a connector and fixed therein so as to minimize the width of the corner segment.

The releasable connectors 40 may take the form of locking ferrules, couplers, sleeves, loops, push-in fittings, coupling nuts, turnbuckles, or the like. It is understood that the connectors 40 couple the border wire segments 38 in end-to-end relation and should be releasable to allow for possible later disassembly of the border wire.

The vertically-oriented double butterfly edge springs 27, described in greater detail hereinafter, are located between the top and bottom border wires 25 and 26 to provide edge support.

To assemble the supporting structure and form a single unit, individual border wire segments 38 are inserted through the spring bands 37 and through the sleeves in the butterfly springs 27 with adjacent border wire segments 38 being joined by a connector 40. Preferably, the bands 37 have an opening sufficiently large relative to the border wire diameter to allow the border wire segments 38 to easily pass through, but are not so large as to allow the border wire segments to move away from a position adjoining the mattress borders.

The border wires 25 and 26 provides a firm, well-defined edge on the mattress border and the butterfly edge springs 27 provide edge stability to prevent sagging at the edge. The butterfly springs 27 are spaced around and outward of the sides of the mattress core and are vertically positioned intermediate the upper and lower border wires.

When the mattress structure has been assembled, it is encased in a fabric outer cover 22. The cover 22 is closed by suitable fastener means, such as a zipper or Velcro (not shown). The cover includes a padding layer and a finishing upholstery fabric layer.

Figure 3:
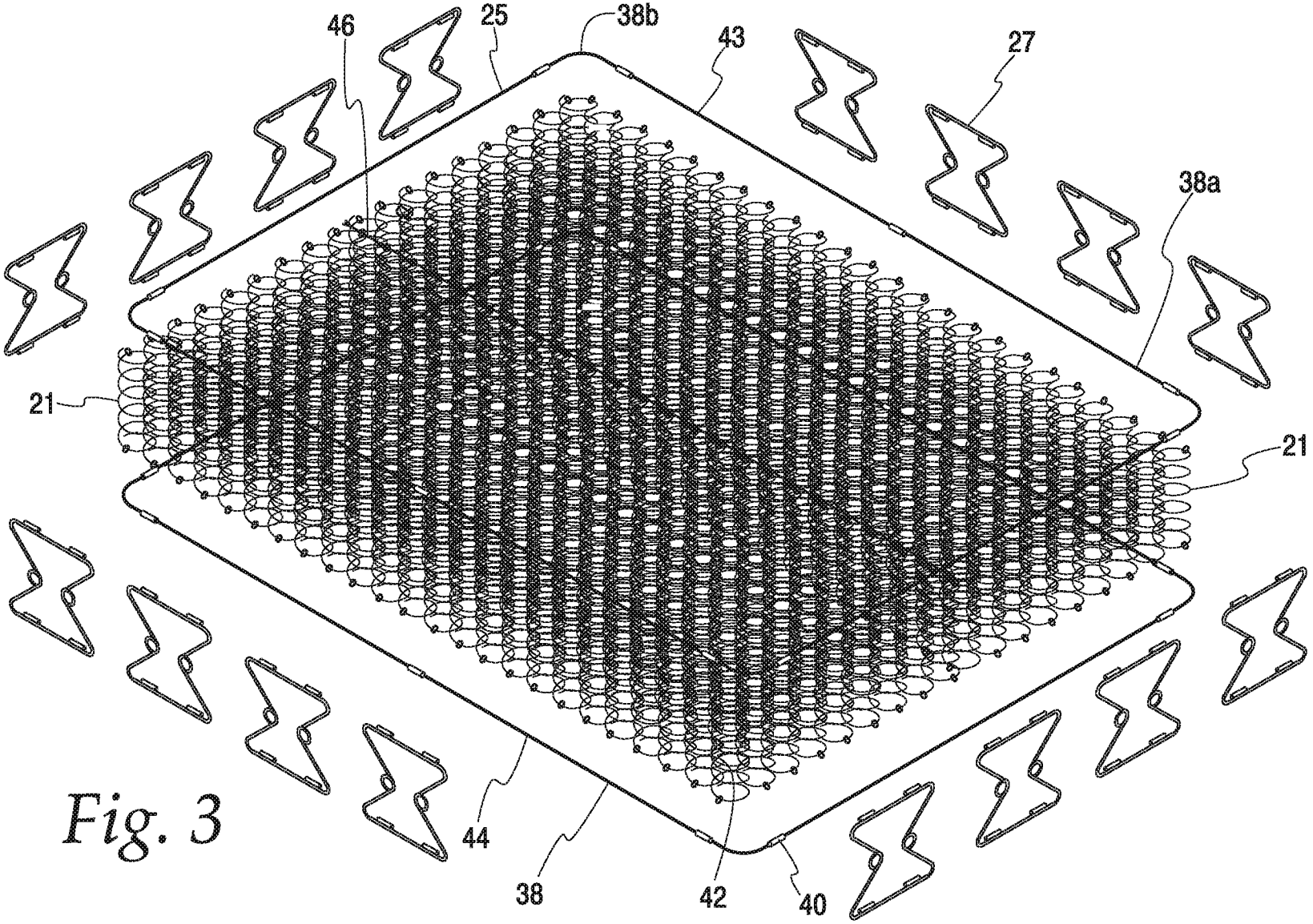
FIG. 3 is an exploded perspective view of a pair of coiled spring mattresses joined together.

Referring to FIG. 3, two coiled spring mattress core structures 21 are shown joined together in side-by-side relation along their inner borders to form a combined core assembly 42. As seen, border wires 43 and 44 comprised of border wire segments 38 joined end-to-end by connectors 40 extend around the combined cores at the upper and lower edges with the butterfly edge springs 27 extending vertically between them. In addition, a longitudinally extending flexible cord 46 is alternately passed through, i.e., interweaved with, the bands 37 of adjoining inner borders to hold the two cores 21 together and limit relative movement therebetween. The cord 46 may be threaded through rings along the top border or through rings along both the top and bottom borders. When secured together, an outer cover (not shown) encases the combined core.

Figure 4:
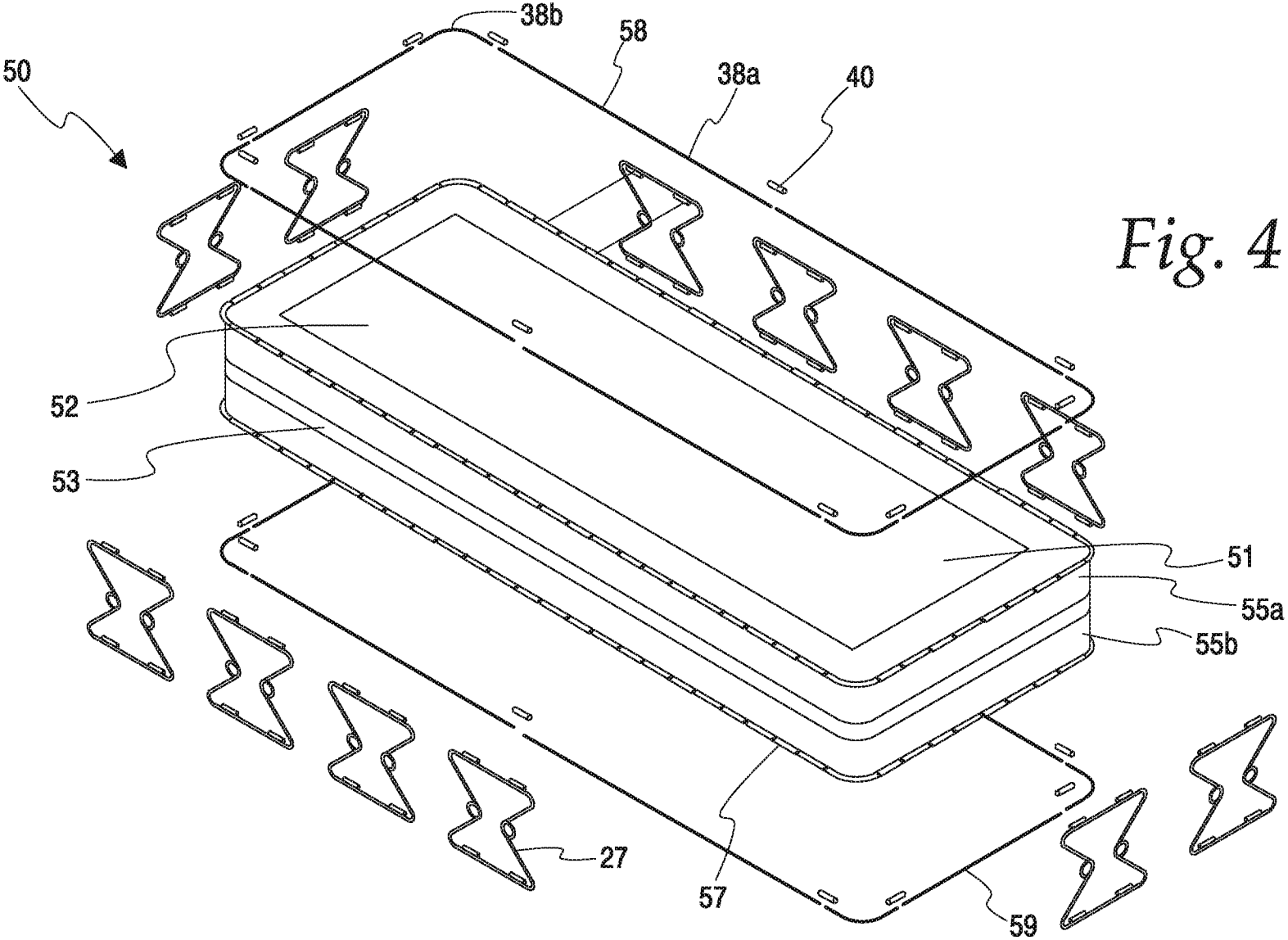
FIG. 4 is an exploded perspective view of a foam mattress.

In FIG. 4, a foam mattress, generally designated 50, is shown and has a foam core body 51 with a top wall 52, a bottom wall (not numbered), and a surrounding side wall 53. Attached along the top and bottom borders are L-shaped loop strips 54*a* and 54*b*, which are described in more detail hereinafter with respect to FIGS. 7-9. The top strip 54*a* has a first skirt portion 55 fixed to the top wall 52 and a second skirt portion 56 fixed to the side wall 53. Intermediate the skirt portions 55 and 56, the strip forms a series of loops, collectively designated 57, extending outward from the border defining a series of through-openings adapted to receive the border wire segments 38, which are coupled together by releasable connectors 40 thereby forming top and bottom border wires 58 and 59, which are vertically separated by the butterfly edge springs 27. The bottom strip 54*b* is similarly configured.

Figure 5:
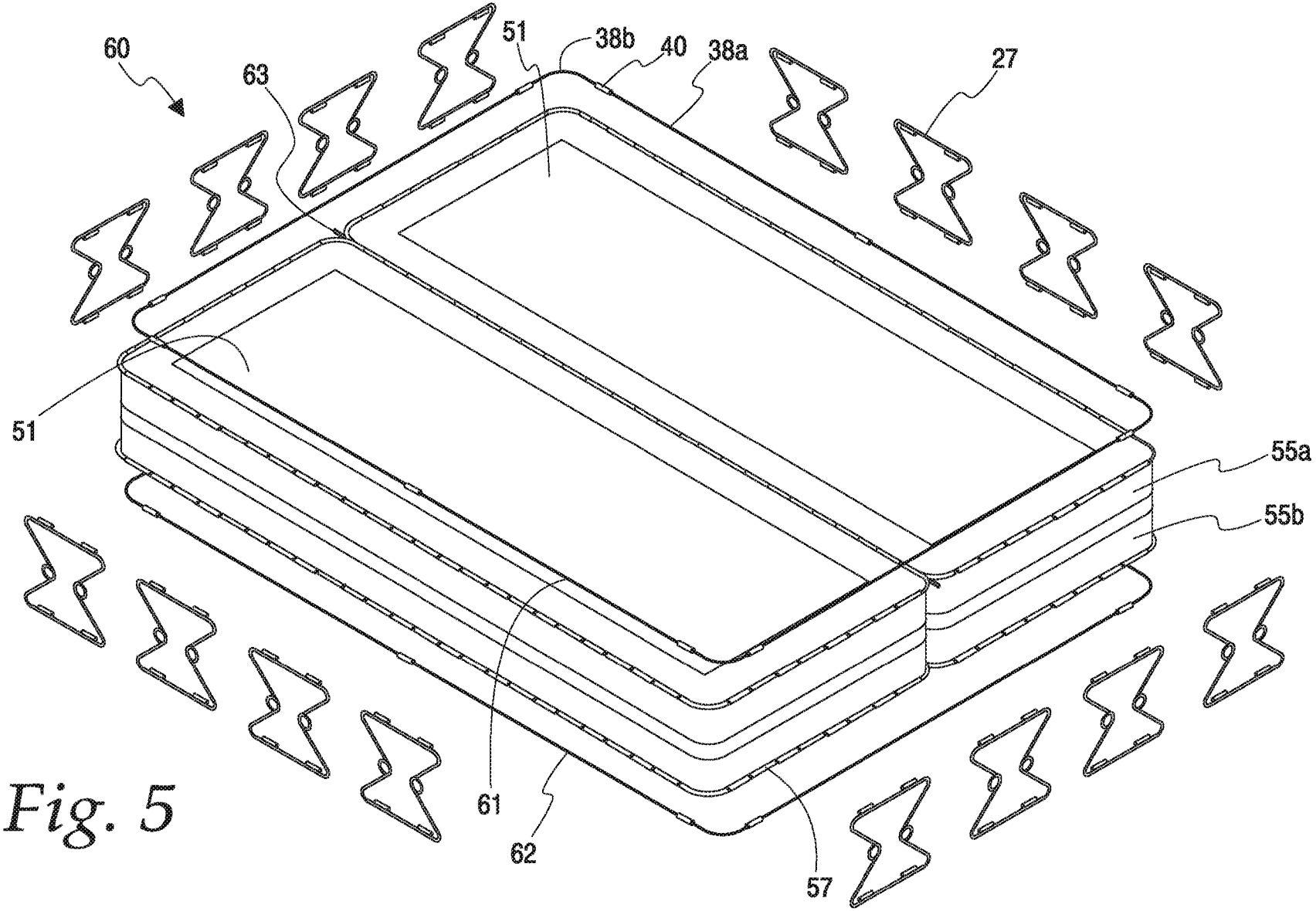
FIG. 5 is an exploded perspective view of a pair of foam mattresses joined together.

In FIG. 5, two foam mattress cores 51 are shown joined together in side-by-side relation to form a combined core assembly, generally designated 60. As seen, top and bottom border wires 61 and 62 are comprised of border wire segments 38*a* and 38*b* joined end-to-end by releasable connectors 40 and extend around the combined foam cores along the top and bottom borders with the butterfly edge springs 27 extending vertically between them. In addition, a longitudinally-extending flexible cord 63 interlaced through the loops 57 of adjoining inner borders holds the two cores together and limits relative movement between the two foam cores. The cord 63 may be threaded through the loops along the top border or through loops along both the top and bottom borders.

Figure 6:
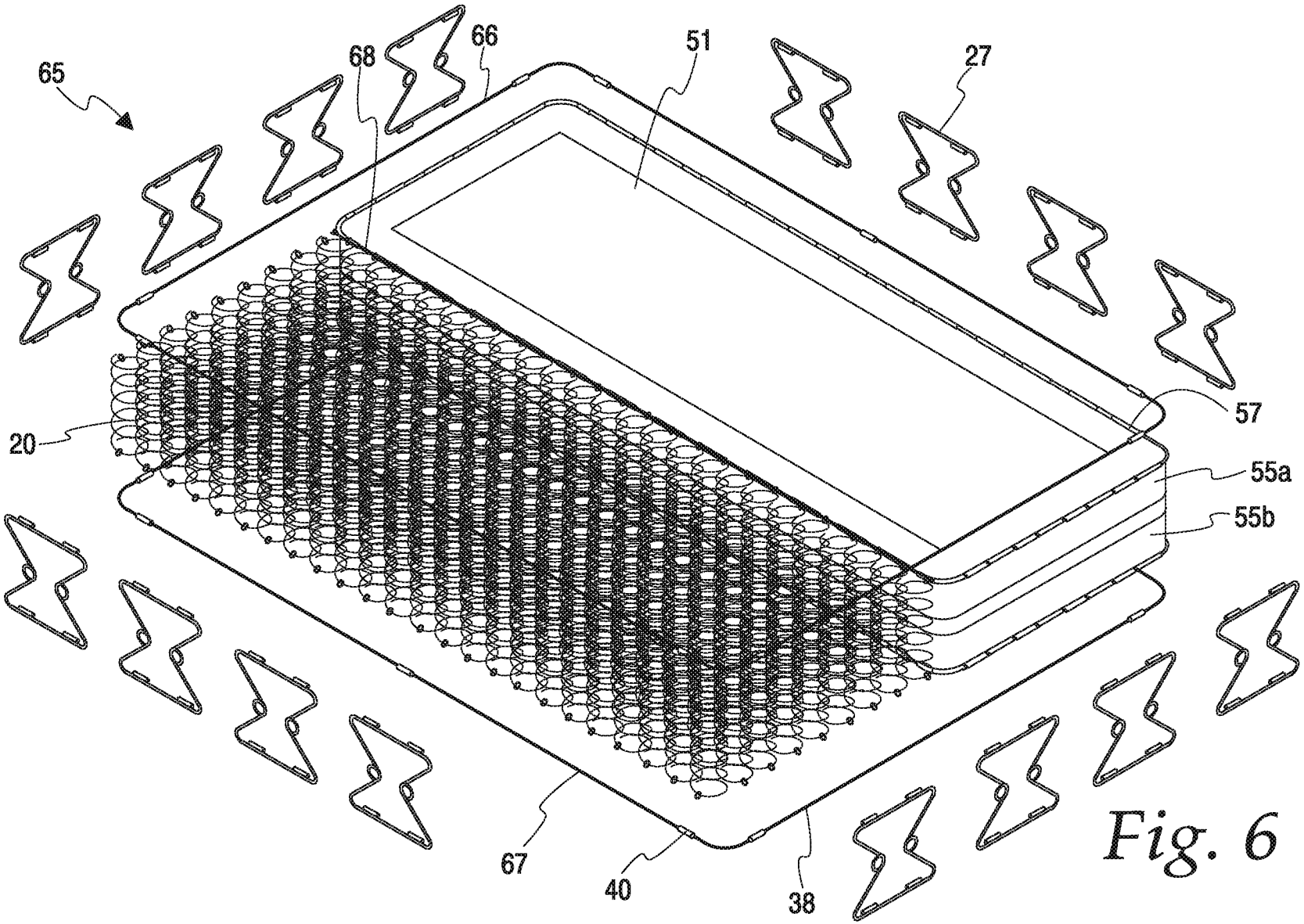
FIG. 6 is an exploded perspective view of a coiled spring mattress joined with a foam mattress.

In FIG. 6, a spring coil mattress core is shown joined together with a foam mattress coil to form a combined core structure, generally designed 65. Construction of the double mattress 65 is similar to that shown in FIGS. 3 and 5. Herein, border wire segments 38 are threaded through the outer bands 37 of the spring core mattress 20 and through the outer loops 57 of the foam mattress 51 and joined together by releasable connectors 40 to provide continuous top and bottom border wires 66 and 67 around the entire assembly. The inner rings of the spring core mattress and the inner loops of the foam core mattress are interweaved by a flexible cord 68 extending alternately through the bands 37 and loops 57 to hold the mattresses together.

Figure 7:
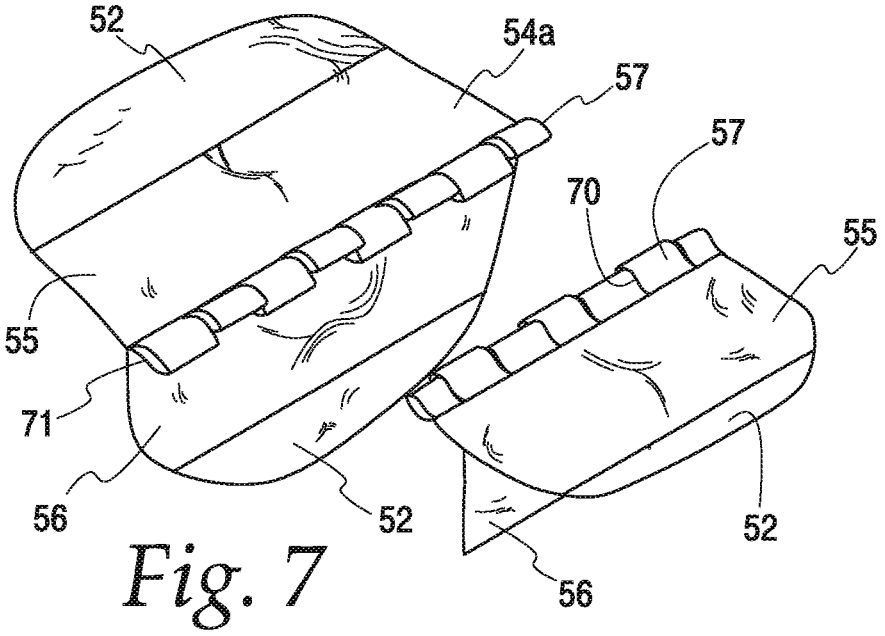
FIG. 7 is an enlarged fragmentary perspective view of two looped strips used with a foam core.
Figure 8:
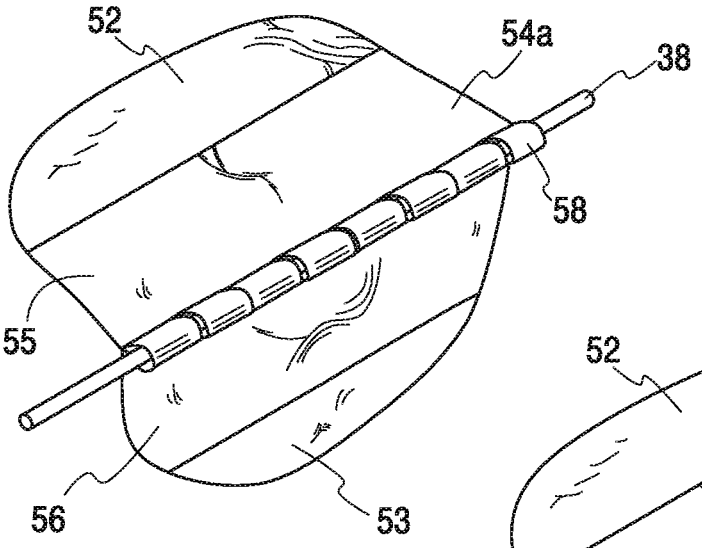
FIG. 8 is an enlarged fragmentary perspective view of two looped strips joined by a border wire.
Figure 9:
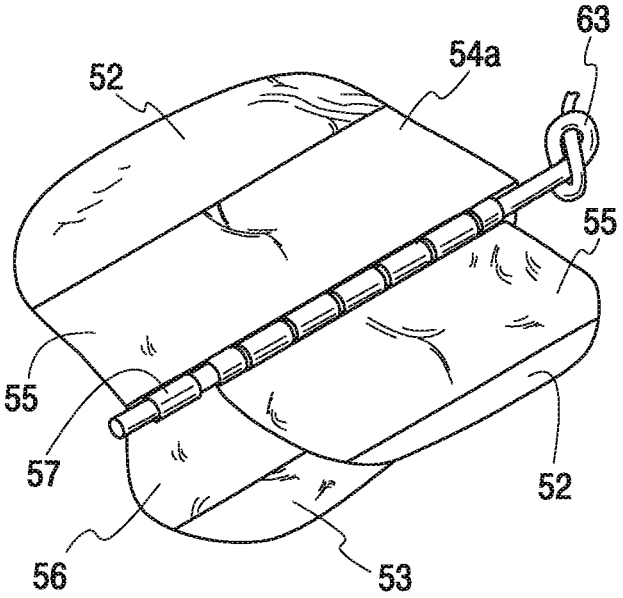
FIG. 9 is an enlarged fragmentary perspective view of two looped strips joined by a flexible cord.

In FIGS. 7-9, the construction of the flexible border strip 54*a* is shown in detail. In FIG. 7, a first loop strip 54*a* is shown attached to the border of a foam mattress, while a second strip is shown in spaced relation. The L-shaped strip 54*a* may be formed by folding a length of suitable material in a longitudinal direction so as to form two orthogonally diverging skirt portions 55 and 56 with an intermediate loop. Thereafter, a series of transverse slitting cuts 70 are made in the loop forming gaps and defining a series of loops 57 with aligned through-openings 71.

In FIG. 8, a border wire segment 38 is shown passing through all of the separate loops 57 which extend outwardly from the border. The strip 54*a* is attached to the corner of the foam mattress along the border by fixing skirt portion 55 to the top wall 52 of the mattress and skirt portion 56 to the side wall 53 of the mattress by using adhesive or by any other suitable method.

In FIG. 9, portions of two adjoining mattresses are shown in connected relation. The loops 57 of adjoining mattresses are interweaved by alternately folding a loop of one mattress downward and locating an opposing loop of the other adjacent mattress into the open space. The flexible cord 63 is then passed through all of the aligned loops 57 and the ends tied off. As a result, relative movement between two mattresses is limited.

Where a foam massage having long loops is joined to a spring mattress having narrow rings, the narrow rings may be positioned in the narrow gaps between the loop bands without folding them out of the way.

Figure 10:
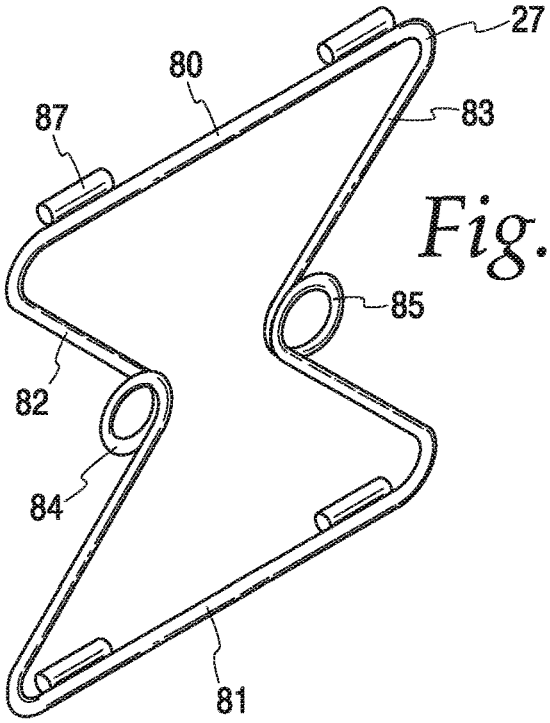
FIG. 10 is an enlarged perspective view of a first embodiment of a butterfly edge support spring with sleeves extending inwardly from the side of the butterfly edge support.
Figure 11:
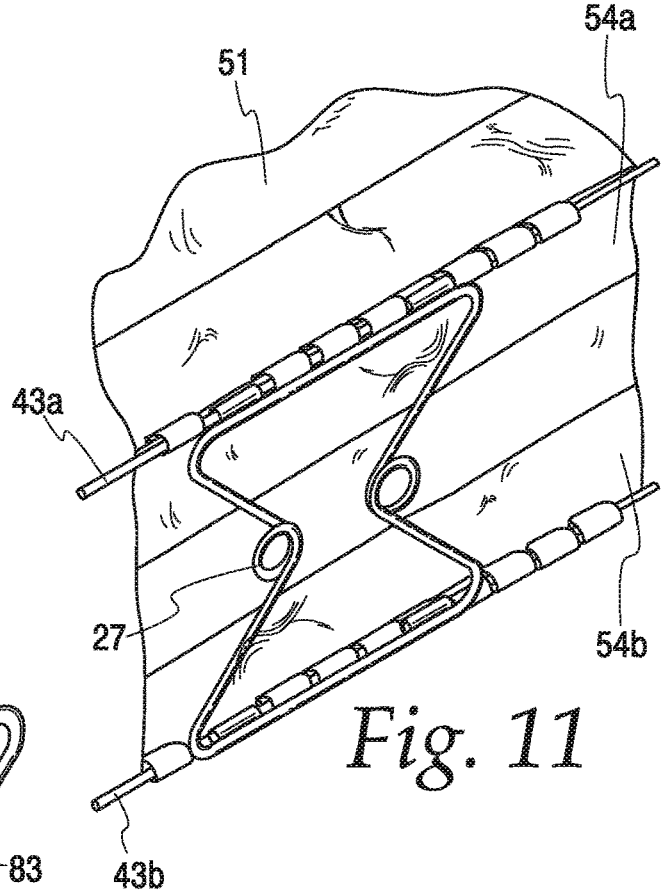
FIG. 11 is an enlarged perspective view of the edge support spring shown in FIG. 10 mounted between two border wires.
Figure 12:
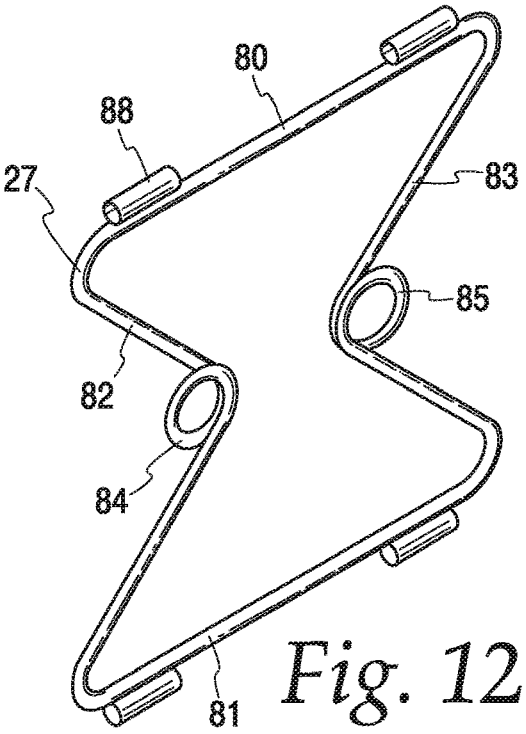
FIG. 12 is an enlarged perspective view of a second embodiment of a butterfly edge support spring with sleeves extending upwardly and downwardly from the top and bottom of the butterfly edge support.

The construction of a butterfly edge support spring 27 is best seen in FIGS. 10-12. The metal spring 27 includes upper and lower straight mounting portions 80 and 81 and outwardly diverging arm portions 82 and 83 formed with an intermediate torsion loops 84 and 85 connecting the respective ends of the mounting portions 80 and 81.

In FIG. 10, a pair of sleeves, collectively designated 87, are shown fixed to the side of the butterfly spring 27 along the top and bottom mounting portions 80 and 81 and extend inwardly from the butterfly spring 27. To attach the springs 27, the sleeves have through-openings for receiving the border wire segments 38. In FIG. 11, a butterfly spring 27 is shown outward of the mattress with the upper and lower border wires 43*a* and 43*b* passing through the sleeves 87. In FIG. 12, a pair of mounting sleeves, collectively designated 88, are fixed at the top and bottom of the mounting portions 80 and 81 and extend upwardly and downwardly so that the butterfly spring 27 may be positioned directly between the border wires when attached.

Figure 13:
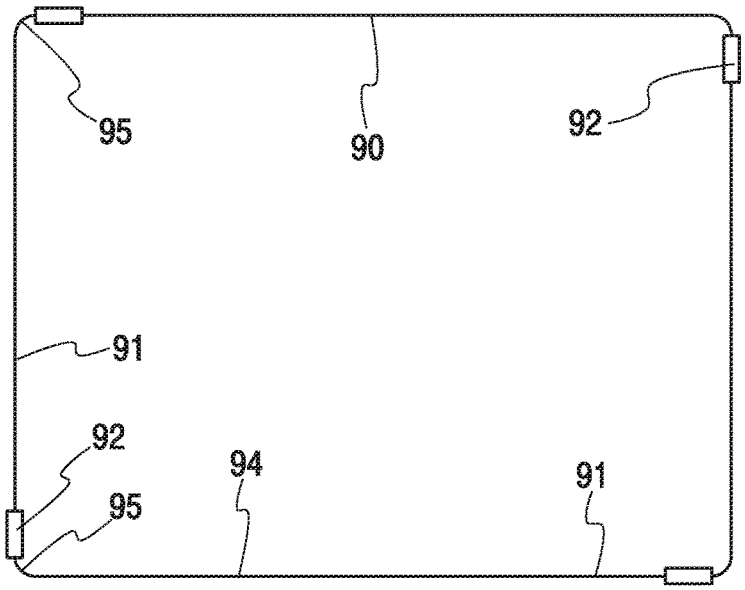
FIG. 13 is a top plan view of a border wire assembled from four border wire segments.

In FIG. 13, another embodiment of an assembled border wire 90 is disclosed that has relatively few parts and has a relatively a compact format when disassembled. The assembled border wire 90 comprises four wires 91 and four connectors 92 and forms a generally rectangular shape with rounded corners. Each border wire 91 includes a long straight portion 94, an arcuate 90° corner portion 95, and a short straight portion held in the connector 92 and not shown. Each connector 92 joins the end of a long portion 94 with the end of a short portion of an adjacent wire. The short straight portion is tangent to the end of the corner portion 95 and has a length only sufficient to extend into and be secured within one side of the connector. This results in a small overall width for packing and shipping.

Figure 14:
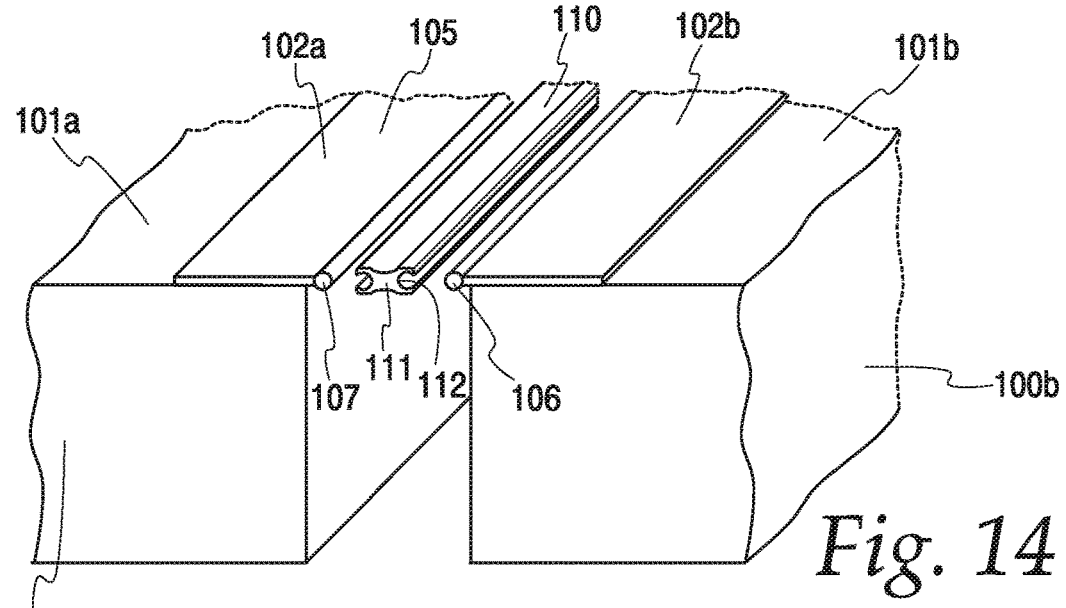
FIG. 14 is an enlarged, partial, exploded, perspective view of two mattresses joined together by an elongate union.

In FIG. 14, an apparatus for connecting two adjacent mattresses 100*a* and 100*b* together using a male-female slide and slot construction is shown. Elongate strips 101*a* and 101*b* are suitably fixed to the upper surfaces 102*a* and 102*b* along the facing edges of the two mattresses. Each strip 102*a* and 102*b* includes an inner flat portion 105 secured to the mattress, an outer neck portion 106 extending laterally from the periphery of the mattress and an enlarged slide, or head portion 107, carried at the outward end of the neck portion 106 that is thicker than the neck portion 106.

An elongate connector, or union 110, which may be formed from extruded plastic, joins two slide strips together. The flat union 110 has a narrow center portion 111 with longitudinal slots, or grooves 112, defined along the two opposed peripheral sides having a size and configuration substantially similar to the head portion 107 of the strip. Each groove 112 is defined by an internal circular channel and an opening extending from the channel to the outer edge at the side of the strip.

As illustrated herein, the mattresses are manufactured with the elongate strips 102 in place, or added to the mattress at a later time. The head portion 107 of the strip has a circular profile and the grooves 112 of the union 110 have C-shaped profiles, such that when mated the head portions 107 are held within the grooves 112 with the flat neck portions 106 extending through the narrow groove openings. Connection is made by the user by sliding the head portions 107 into the ends of the groove channels until the union 110 is completely mated. It is understood that the parts may have a profile differing from the profiles shown provided they have configurations of a size and shape enabling a secured connection.

Figure 16:
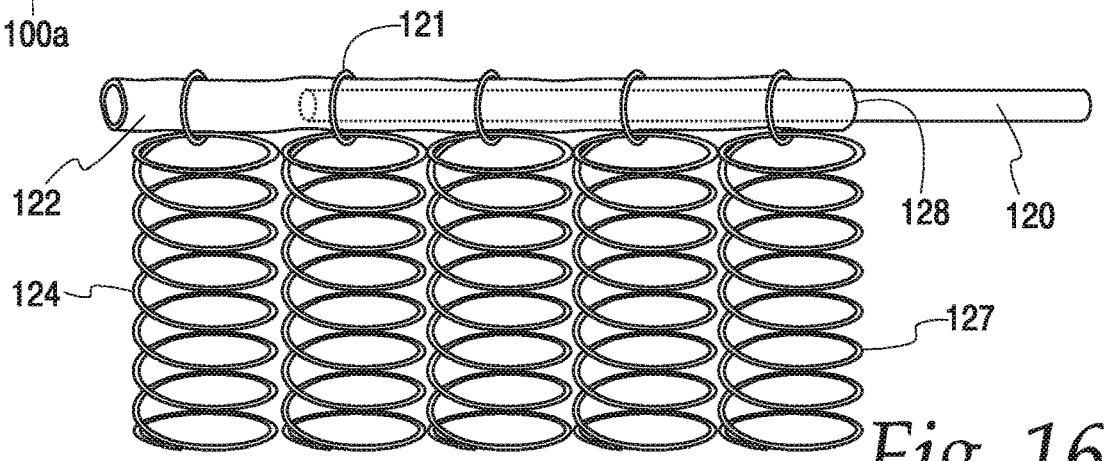
Figure 15:
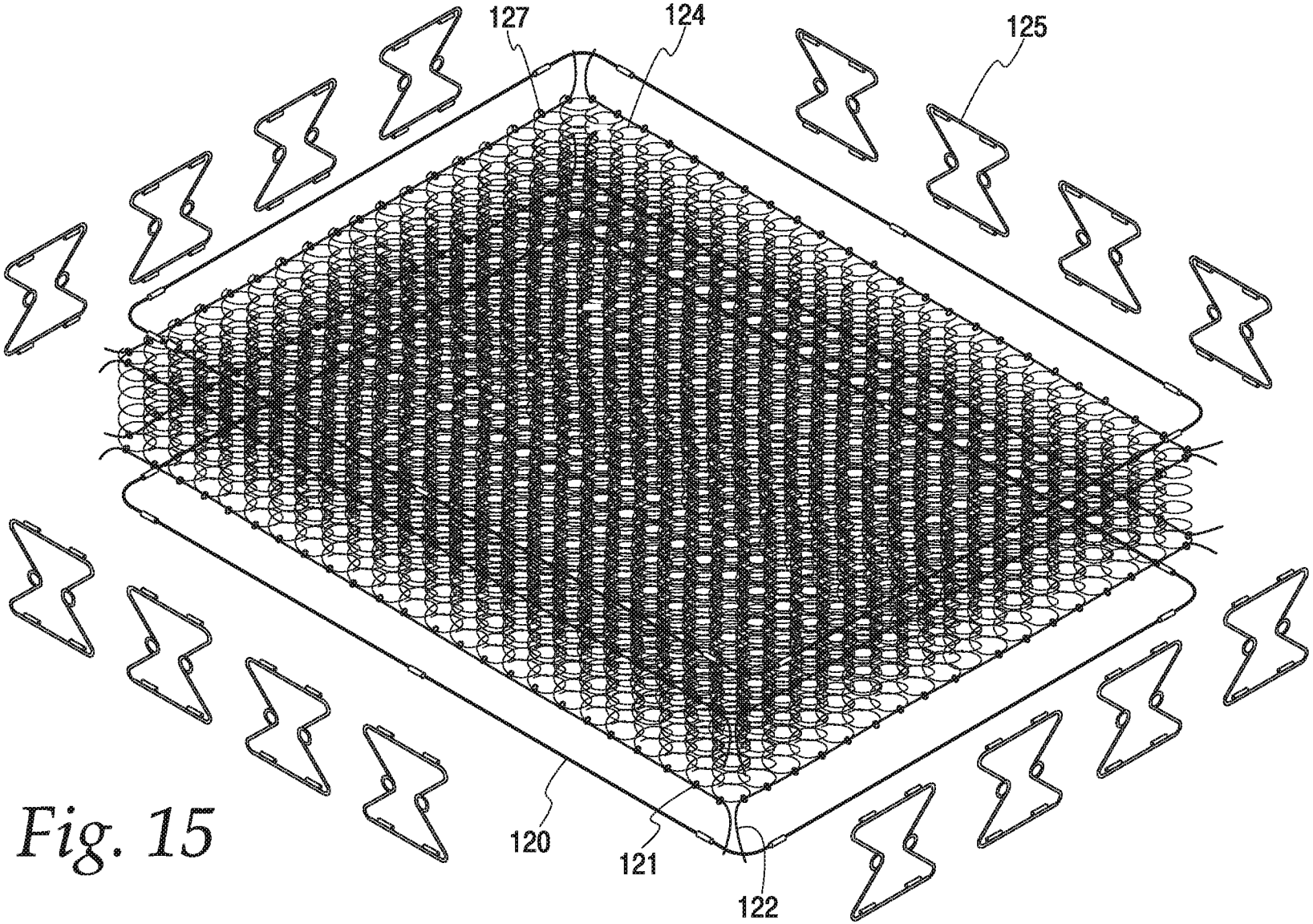
FIG. 15 is an exploded perspective view of a mattress having guide sleeves along its peripheral edges; and, FIG. 16 is an enlarged, partial elevational view of the mattresses of FIG. 15 showing a border wire partially inserted into one end of a guide sleeve threaded through the border bands.

In FIGS. 15 and 16, a mechanism for aiding the user in inserting a border wire 120 into the bands 121 by an end user is disclosed. During manufacture, flexible sleeves, or tubes 122, are threaded through each line of bands 121 at each side of the spring mattress assembly 124 and through the butterfly edge springs 125. The tubes 122 maintain general alignment of the bands 121 at the upper and lower ends of the springs 127 preventing the bands 121 from moving from the outer ends of the springs 127. The tubes 122 are made of a plastic, a textile, or other suitable flexible fabric or material.

As best seen in FIG. 16, the user after unfolding or unrolling the spring assembly 124 inserts the free end of a border wire 120 into the open end 128 of the tube 122, which has a diameter sufficient to allow the border wire to be pushed it. Since the tube 122 is already threaded through the bands 121, the tube 122 guides the border wire 120 through the bands thereby facilitating assembly. A tube 122 is provided along each of the four border edges along the top and bottom of the mattress assembly 124 and may be removed after the border wire 120 is in position by pulling one end of the tube 122 off the end of the border wire 120.

It is contemplated that various types of mattress cores may be joined together side-by-side with each user lying on his or her mattress type whether it have spring core (hard, soft or medium), a foam core, air core, water core, or some other type of support. This can be accomplished if the individual mattress cores are provided with edge bands as described above. When purchased separately, connecting parts, such as border wires, connectors, etc., need not be provided. However, to enable aftermarket connections to mattresses having bands installed, a kit may be provided. A kit might include a plurality of border wire segments, connectors for joining the segments together, and optionally butterfly edge springs. The kit enables two mattresses to be joined, for example, two foam mattresses, a foam mattress and a spring mattress, or other configurations.

INDUSTRIAL APPLICABILITY

While specific embodiments of the invention are illustrated herein, it is understood that the mattress assembly may be broken down into smaller or compactable components that are more easily transported. Also, two mattresses may be joined together with each having a different construction. For instance, the two mattresses may have a different firmness or they may be of different construction, one with a spring core and one with a foam core. A large mattress is thereby constructed for the specific desires and requirements of the individual end user or users.

From the foregoing, it will be observed that numerous variations and modifications may be effected without departing from the spirit and scope of the invention. It will also be observed that the various elements of the invention may be in any number of combinations, and that all of the combinations are not enumerated here. It will be understood that no limitation with respect to the specific apparatus illustrated herein is intended or should be inferred. While specific embodiments of the invention have been disclosed, one of ordinary skill in the art will recognize that one can modify the materials, dimensions and particulars of the embodiments without straying from the inventive concept.

Other aspects, objects and advantages of this invention can be obtained from a study of the drawings and the foregoing disclosure.

It should be understood that the terms "top," "bottom," "upper," "lower," "inner," "outer," "end," "side," "first," "second," "height," "width," "length," and similar terms as used herein, have reference only to the structure shown in the drawings and are utilized only to facilitate describing the invention. The terms and expressions employed herein have been used as terms of description and not of limitation.

As used herein, the term "adjoin" shall mean "to be close to or in contact with"; the term "within" shall mean "to be partially or completely inside of"; the term "axial" refers to a direction that is substantially straight; the term "transverse" refers to a direction other than the axial direction (e.g., orthogonal or nonorthogonal).

What is claimed is:

1. A mattress assembly comprising:

a body of resilient foam having a top wall, a bottom wall spaced from the top wall, and an outer peripheral wall extending between the top wall and the bottom wall to define a head end, a foot end, and lateral sides, the resilient foam filling the space between the top wall and the bottom wall inward of the peripheral wall for supporting a user lying thereon;

the top wall and the peripheral wall defining a top border and the bottom wall and the peripheral wall defining a bottom border along the edges of the body at the head end, the foot end, and the lateral sides, each of the borders being generally rectangular;

a flexible strip along the top border and a flexible strip along the bottom border, each of the flexible strips being fixed to the body and having a plurality of outwardly extending loops with through-openings extending along and outward from its respective border at the head end, the foot end, and the lateral sides of the body;

a plurality of border wire segments arranged in end-to-end relation along each of the borders to form pairs of adjacent segments having opposed connecting ends; and, a plurality of connectors with one of the plurality of connectors being disposed between each pair of adjacent segments to join the connecting ends of each pair of adjacent segments together to form continuous top and bottom border wires extending through the through-openings along the borders.

2. The mattress assembly of claim 1 wherein each of the flexible strips have a tube-shaped loop portion having the loops with through-openings and a skirt portion extending from the loop portion with the skirt portion being fixed to one of the walls of the body adjacent one of the borders.

3. The mattress assembly of claim 2 wherein one of the flexible strips extends continuously along the top border and another of the flexible strips extends along the bottom border, and the tube-shaped loop portion of each flexible strip is divided into a series of segments defining aligned through-openings for receiving the border wire segments.

4. The mattress assembly of claim 1 wherein the connectors are releasable.

5. The mattress assembly of claim 4 wherein the connectors are locking ferrules.

6. The mattress assembly of claim 1 further including an outer cover encasing the body and the border wire segments.

7. The mattress assembly of claim 1 further including a plurality of edge support springs having upper and lower bands with through-openings, the edge support springs being arranged in spaced relation along the periphery of the body intermediate the top and bottom border wires to provide vertical separation between the top and bottom border wires extending through the through-openings of the edge support springs.

8. A mattress assembly comprising:

a pair of resilient foam bodies for supporting a user lying thereon, each of the foam bodies having a top wall, a bottom wall, and a peripheral wall extending between the top wall and the bottom wall, the top wall and the peripheral wall defining a top border and the bottom wall and the peripheral wall defining a bottom border along the edges of each of the foam bodies with each of the borders being generally rectangular and having a head end, a foot end, and lateral sides;

the foam bodies being disposed in laterally-adjacent relation to each other so as to define inner and outer lateral sides with at least a portion of the loops at the inner lateral side of one foam body being interweaved with at least a portion of the loops at the inner lateral side of the adjacent foam body;

each of the foam bodies having a flexible strip along the top border and a flexible strip along the bottom border, one flexible strip being fixed to each of the foam bodies and each flexible strip having a plurality of loops with through-openings;

a plurality of border wire segments arranged in end-to-end relation to form pairs of adjacent segments having opposed connecting ends;

a plurality of connectors with one of the plurality of connectors being disposed between each pair of adjacent segments to join the connecting ends of each pair of adjacent segments together to form continuous top and bottom border wires along each of the borders extending through the through-openings at the head end, the foot end, and the outer lateral sides of the foam bodies;

a flexible cord extending through the through-openings in the interweaved loops at the inner lateral sides of the foam bodies to limit relative movement between the foam bodies; and, wherein the border wires extend through loops on the outer lateral sides of both of the foam bodies.

9. The mattress assembly of claim 8 further including an outer cover encasing both of the foam bodies and the border wire segments.

10. A mattress assembly comprising:

a resilient foam body for supporting a user lying thereon having a top wall, a bottom wall, and a peripheral wall defining a top border and a bottom border along the edges of the foam body, each of the borders being generally rectangular and having a head end, a foot end, and lateral sides;

a flexible strip along the top border and a flexible strip along the bottom border fixed to the foam body, each of the flexible strips having a loop portion and a pair of skirt portions extending outward from the loop portion and from each other, the loop portions having loops with through-openings, each flexible strip having one skirt portion fixed to one of the top wall and bottom wall and the other skirt portion fixed to the peripheral wall, the loop portions being outward from the border when the pair of skirt portions are fixed to the foam body;

a plurality of border wire segments arranged in end-to-end relation along each of the borders to form pairs of adjacent segments having opposed connecting ends; and, a plurality of connectors with one of the plurality of connectors being disposed between each pair of adjacent segments to join the connecting ends of each pair of adjacent segments together to form continuous top and bottom border wires extending through the through-openings along the borders.

11. The mattress assembly of claim 10 further including a plurality of edge support springs having upper and lower bands with through-openings, the edge support springs being arranged in spaced relation along the periphery of the foam body intermediate the top and bottom border wires to provide vertical separation between the top and bottom border wires extending through the through-openings of the edge support springs.

12. A mattress assembly comprising:

a resilient foam body for supporting a user lying thereon having a top wall, a bottom wall and a peripheral wall extending between the top wall and the bottom wall, the top wall and the peripheral wall defining a top border and the bottom wall and the peripheral wall defining a bottom border, each of the borders being generally rectangular and having a head end, a foot end, and lateral sides;

a flexible strip along the top border and a flexible strip along the bottom border, each of the flexible strips having a loop portion and a pair of skirt portions extending outward from the loop portion and from each other, the loop portion having the loops with through-openings, one skirt portion being fixed to one of the top wall and bottom wall and the other skirt portion being fixed to the peripheral wall, wherein the loop portion is outward from the border when the skirt portions are fixed to the foam body;

a plurality of border wire segments arranged in end-to-end relation along each of the borders to form pairs of adjacent segments having opposed connecting ends; and, a plurality of releasable connectors with one of the plurality of releasable connectors being disposed between each pair of adjacent segments to join the connecting ends of each pair of adjacent segments together to form continuous top and bottom border wires extending through the through-openings along the borders.

13. The mattress assembly of claim 12 further including a plurality of edge support springs having upper and lower bands with through-openings, the edge support springs being arranged in spaced relation along the periphery of the foam body intermediate the top and bottom border wires to provide vertical separation between the top and bottom border wires extending through the through-openings of the edge support springs.

* * * * *